US007288002B2

(12) United States Patent
Rodrigues et al.

(10) Patent No.: US 7,288,002 B2
(45) Date of Patent: Oct. 30, 2007

(54) COAXIAL CABLE CONNECTOR WITH SELF-GRIPPING AND SELF-SEALING FEATURES

(75) Inventors: Julio Rodrigues, Collierville, TN (US); Randy Ward, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/582,787

(22) Filed: Oct. 18, 2006

(65) Prior Publication Data

US 2007/0087628 A1 Apr. 19, 2007

Related U.S. Application Data

(60) Provisional application No. 60/728,099, filed on Oct. 19, 2005.

(51) Int. Cl.
*H01R 9/05* (2006.01)

(52) U.S. Cl. ..... 439/578; 439/584; 439/439; 439/440; 439/441

(58) Field of Classification Search ..... 439/578, 439/584, 585, 439, 440, 441, 274
See application file for complete search history.

(56) References Cited

U.S. PATENT DOCUMENTS

| | | | |
|---|---|---|---|
| 2,258,737 | A | 10/1941 | Browne |
| 2,549,647 | A | 4/1951 | Turenne |
| 3,184,706 | A | 5/1965 | Atkins |
| 3,292,136 | A | 12/1966 | Somerset |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,668,612 | A | 6/1972 | Nepovim |
| 3,671,922 | A | 6/1972 | Zerlin et al. |
| 3,710,005 | A | 1/1973 | French |
| 3,778,535 | A | 12/1973 | Forney, Jr. |
| 3,781,762 | A | 12/1973 | Quackenbush |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |

(Continued)

FOREIGN PATENT DOCUMENTS

| | | |
|---|---|---|
| DE | 1 515 398 | 11/1962 |

(Continued)

*Primary Examiner*—Tho D. Ta
(74) *Attorney, Agent, or Firm*—Hoffmann & Baron, LLP

(57) ABSTRACT

A coaxial cable connector includes a connector body having a rearward cable receiving end and a gripping ferrule fixed within the rearward cable receiving end of the connector body. The gripping ferrule includes at least one flexible finger deflected in a radially inward direction and extending in a forward direction opposite the rearward cable receiving end of the connector body for permitting forward insertion of a cable into the connector body and for gripping the cable to prevent rearward removal of the cable from the connector body.

18 Claims, 4 Drawing Sheets

U.S. PATENT DOCUMENTS

| | | | | |
|---|---|---|---|---|
| 3,915,539 | A | | 10/1975 | Collins |
| 3,936,132 | A | | 2/1976 | Hutter |
| 3,963,320 | A | | 6/1976 | Spinner |
| 3,976,352 | A | | 8/1976 | Spinner |
| 3,985,418 | A | | 10/1976 | Spinner |
| 4,046,451 | A | | 9/1977 | Juds et al. |
| 4,053,200 | A | | 10/1977 | Pugner |
| 4,059,330 | A | | 11/1977 | Shirey |
| 4,093,335 | A | | 6/1978 | Schwartz et al. |
| 4,126,372 | A | | 11/1978 | Hashimoto et al. |
| 4,131,332 | A | | 12/1978 | Hogendobler et al. |
| 4,165,554 | A | | 8/1979 | Faget |
| 4,168,921 | A | | 9/1979 | Blanchard |
| 4,227,765 | A | | 10/1980 | Neumann et al. |
| 4,250,348 | A | | 2/1981 | Kitagawa |
| 4,280,749 | A | | 7/1981 | Hemmer |
| 4,339,166 | A | | 7/1982 | Dayton |
| 4,346,958 | A | | 8/1982 | Blanchard |
| 4,354,721 | A | | 10/1982 | Luzzi |
| 4,373,767 | A | | 2/1983 | Cairns |
| 4,400,050 | A | | 8/1983 | Hayward et al. |
| 4,408,821 | A | | 10/1983 | Forney, Jr. |
| 4,408,822 | A | | 10/1983 | Nikitas |
| 4,421,377 | A | | 12/1983 | Spinner |
| 4,444,453 | A | | 4/1984 | Kirby et al. |
| 4,456,323 | A | | 6/1984 | Pitcher et al. |
| 4,515,427 | A | | 5/1985 | Smit |
| 4,540,231 | A | | 9/1985 | Forney, Jr. |
| 4,545,637 | A | | 10/1985 | Bosshard et al. |
| 4,575,274 | A | | 3/1986 | Hayward et al. |
| 4,583,811 | A | | 4/1986 | McMills |
| 4,593,964 | A | | 6/1986 | Forney, Jr. et al. |
| 4,596,434 | A | | 6/1986 | Saba et al. |
| 4,596,435 | A | | 6/1986 | Bickford |
| 4,598,961 | A | | 7/1986 | Cohen |
| 4,600,263 | A | | 7/1986 | DeChamp et al. |
| 4,614,390 | A | | 9/1986 | Baker |
| 4,632,487 | A | | 12/1986 | Wargula |
| 4,655,159 | A | | 4/1987 | McMills |
| 4,660,921 | A | | 4/1987 | Hauver |
| 4,668,043 | A | | 5/1987 | Saba et al. |
| 4,674,818 | A | | 6/1987 | McMills et al. |
| 4,676,577 | A | | 6/1987 | Szegda |
| 4,682,832 | A | | 7/1987 | Punako et al. |
| 4,688,876 | A | | 8/1987 | Morelli |
| 4,688,878 | A | | 8/1987 | Cohen et al. |
| 4,703,987 | A | | 11/1987 | Gallusser et al. |
| 4,717,355 | A | | 1/1988 | Mattis |
| 4,746,305 | A | | 5/1988 | Nomura |
| 4,747,786 | A | | 5/1988 | Hayashi et al. |
| 4,755,152 | A | | 7/1988 | Elliot et al. |
| 4,761,146 | A | | 8/1988 | Sohoel |
| 4,772,222 | A | | 9/1988 | Laudig et al. |
| 4,789,355 | A | | 12/1988 | Lee |
| 4,806,116 | A | | 2/1989 | Ackerman |
| 4,834,675 | A | | 5/1989 | Samchisen |
| 4,854,893 | A | | 8/1989 | Morris |
| 4,857,014 | A | | 8/1989 | Alf et al. |
| 4,869,679 | A | | 9/1989 | Szegda |
| 4,874,331 | A | | 10/1989 | Iverson |
| 4,892,275 | A | | 1/1990 | Szegda |
| 4,902,246 | A | | 2/1990 | Samchisen |
| 4,906,207 | A | | 3/1990 | Banning et al. |
| 4,923,412 | A | | 5/1990 | Morris |
| 4,925,403 | A | | 5/1990 | Zorzy |
| 4,927,385 | A | | 5/1990 | Cheng |
| 4,929,188 | A | | 5/1990 | Lionetto et al. |
| 4,952,174 | A | | 8/1990 | Sucht et al. |
| 4,957,456 | A | | 9/1990 | Olson et al. |
| 4,973,265 | A | | 11/1990 | Heeren |
| 4,979,911 | A | | 12/1990 | Spencer |
| 4,990,104 | A | | 2/1991 | Schieferly |
| 4,990,105 | A | | 2/1991 | Karlovich |
| 4,990,106 | A | | 2/1991 | Szegda |
| 5,002,503 | A | | 3/1991 | Campbell et al. |
| 5,007,861 | A | | 4/1991 | Stirling |
| 5,021,010 | A | | 6/1991 | Wright |
| 5,024,606 | A | | 6/1991 | Ming-Hwa |
| 5,037,328 | A | | 8/1991 | Karlovich |
| 5,066,248 | A | | 11/1991 | Gaver, Jr. et al. |
| 5,073,129 | A | | 12/1991 | Szegda |
| 5,083,943 | A | | 1/1992 | Tarrant |
| 5,120,260 | A | | 6/1992 | Jackson |
| 5,127,853 | A | | 7/1992 | McMills et al. |
| 5,131,862 | A | | 7/1992 | Gershfeld |
| 5,141,451 | A | | 8/1992 | Down |
| 5,161,993 | A | | 11/1992 | Leibfried, Jr. |
| 5,195,906 | A | | 3/1993 | Szegda |
| 5,207,602 | A | | 5/1993 | McMills et al. |
| 5,217,391 | A | | 6/1993 | Fisher, Jr. |
| 5,217,393 | A | | 6/1993 | Del Negro et al. |
| 5,269,701 | A | | 12/1993 | Leibfried, Jr. |
| 5,283,853 | A | | 2/1994 | Szegda |
| 5,284,449 | A | | 2/1994 | Vaccaro |
| 5,295,864 | A | | 3/1994 | Birch et al. |
| 5,316,494 | A | | 5/1994 | Flanagan et al. |
| 5,338,225 | A | | 8/1994 | Jacobsen et al. |
| 5,342,218 | A | | 8/1994 | McMills et al. |
| 5,354,217 | A | | 10/1994 | Gabel et al. |
| 5,362,251 | A | * | 11/1994 | Bielak ..... 439/394 |
| 5,371,819 | A | | 12/1994 | Szegda |
| 5,371,821 | A | | 12/1994 | Szegda |
| 5,371,827 | A | | 12/1994 | Szegda |
| 5,393,244 | A | | 2/1995 | Szegda |
| 5,431,583 | A | | 7/1995 | Szegda |
| 5,435,745 | A | | 7/1995 | Booth |
| 5,444,810 | A | | 8/1995 | Szegda |
| 5,455,548 | A | | 10/1995 | Grandchamp et al. |
| 5,456,611 | A | | 10/1995 | Henry et al. |
| 5,456,614 | A | | 10/1995 | Szegda |
| 5,466,173 | A | | 11/1995 | Down |
| 5,470,257 | A | | 11/1995 | Szegda |
| 5,494,454 | A | | 2/1996 | Johnsen |
| 5,501,616 | A | | 3/1996 | Holliday |
| 5,525,076 | A | | 6/1996 | Down |
| 5,529,522 | A | * | 6/1996 | Huang ..... 439/460 |
| 5,542,861 | A | | 8/1996 | Anhalt et al. |
| 5,548,088 | A | | 8/1996 | Gray et al. |
| 5,571,028 | A | | 11/1996 | Szegda |
| 5,586,910 | A | | 12/1996 | Del Negro et al. |
| 5,598,132 | A | | 1/1997 | Stabile |
| 5,607,325 | A | | 3/1997 | Toma |
| 5,620,339 | A | | 4/1997 | Gray et al. |
| 5,632,651 | A | | 5/1997 | Szegda |
| 5,651,699 | A | | 7/1997 | Holliday |
| 5,667,405 | A | | 9/1997 | Holliday |
| 5,863,220 | A | | 1/1999 | Holliday |
| 5,879,191 | A | | 3/1999 | Burris |
| 5,967,852 | A | | 10/1999 | Follingstad et al. |
| 5,975,951 | A | | 11/1999 | Burris et al. |
| 5,997,350 | A | | 12/1999 | Burris et al. |
| 6,032,358 | A | | 3/2000 | Wild |
| 6,089,912 | A | | 7/2000 | Tallis |
| 6,089,913 | A | | 7/2000 | Holliday |
| 6,146,197 | A | | 11/2000 | Holliday et al. |
| 6,217,383 | B1 | | 4/2001 | Holland |
| 6,241,553 | B1 | | 6/2001 | Hsia |
| 6,261,126 | B1 | | 7/2001 | Stirling |
| 6,425,782 | B1 | | 7/2002 | Holland |
| 6,530,807 | B2 | | 3/2003 | Rodrigues et al. |
| 6,558,194 | B2 | | 5/2003 | Montena |
| 6,776,657 | B1 | * | 8/2004 | Hung ..... 439/578 |
| 6,805,584 | B1 | | 10/2004 | Chen |
| 6,817,896 | B2 | | 11/2004 | Deventhal |

| | | | | |
|---|---|---|---|---|
| 6,848,940 | B2 | 2/2005 | Montena | |
| 6,910,919 | B1 * | 6/2005 | Hung | 439/578 |
| 6,976,872 | B1 * | 12/2005 | Wild et al. | 439/578 |
| 7,008,263 | B2 * | 3/2006 | Holland | 439/578 |
| 7,189,113 | B2 * | 3/2007 | Sattele et al. | 439/578 |
| 2004/0102089 | A1 | 5/2004 | Chee | |
| 2004/0229504 | A1 | 11/2004 | Liu | |
| 2005/0170693 | A1 * | 8/2005 | Wild | 439/578 |
| 2006/0252309 | A1 * | 11/2006 | Kodama et al. | 439/578 |

FOREIGN PATENT DOCUMENTS

| | | |
|---|---|---|
| DE | 1 191 880 | 4/1965 |
| DE | 2 221 936 | 5/1972 |
| DE | 2 261 973 | 12/1972 |
| DE | 32 11 008 A 1 | 10/1983 |
| EP | 0 116 157 A1 | 8/1984 |
| EP | 0 167 738 A2 | 1/1986 |
| EP | 0 265 276 B1 | 4/1988 |
| FR | 2 462 798 | 2/1981 |
| GB | 1087228 | 10/1967 |
| GB | 1 270 846 | 4/1972 |
| GB | 2019 665 A | 10/1979 |
| GB | 2 079 549 A | 1/1982 |
| GB | 2079 549 A | 1/1982 |
| WO | 93/24973 | 12/1993 |
| WO | 96/08854 | 3/1996 |

* cited by examiner

PREPARED CABLE

INSTALLED CONNECTOR

COAXIAL CABLE CONNECTOR WITH SELF-GRIPPING AND SELF-SEALING FEATURES

CROSS-REFERENCE TO RELATED APPLICATIONS

This application claims the benefit of U.S. Provisional Application No. 60/728,099, filed on Oct. 19, 2005.

FIELD OF THE INVENTION

The present invention relates generally to connectors for terminating coaxial cable. More particularly, the present invention relates to a coaxial cable connector having structural features to enhance gripping of a coaxial cable and to provide sealing of the interior of the connector from the environment.

BACKGROUND OF THE INVENTION

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Upon assembly to a coaxial cable, the annular post is inserted between the foil covered insulator and the conductive shield of the cable.

One drawback with conventional coaxial connectors is the need for a special tool to lock the locking sleeve to the connector body and thereby secure the cable in the connector. Additionally, manipulation of the tool requires a modicum of skill and is somewhat time consuming. A mistake made in the preparation and locking process may result in a faulty connector installation.

Accordingly, it would be desirable to provide a coaxial cable connector that eliminates the need for a special tool to install the connector on the end of a prepared coaxial connector. It would be further desirable to provide a coaxial cable connector with structural features to enhance gripping and sealing.

OBJECTS AND SUMMARY OF THE INVENTION

It is an object of the present invention to provide a coaxial cable connector for terminating a coaxial cable.

It is a further object of the present invention to provide a coaxial cable connector having structure to enhance gripping and sealing of a coaxial cable, especially a small diameter coaxial cable.

It is still another object of the present invention to provide a coaxial cable connector that does not require a special tool to install the connector on the end of a prepared coaxial cable.

In the efficient attainment of these and other objects, the present invention provides a coaxial cable connector. The connector of the present invention generally includes a connector body having a rearward cable receiving end and a gripping ferrule fixed within the rearward cable receiving end of the connector body. The gripping ferrule includes at least one flexible finger deflected in a radially inward direction and extending in a forward direction opposite the rearward cable receiving end of the connector body for permitting forward insertion of a cable into the connector body and for gripping the cable to prevent rearward removal of the cable from the connector body.

In a preferred embodiment, the connector further includes an annular post disposed within the connector body and a nut rotatably coupled to said post. The connector body preferably includes an internal ramp portion for deflecting the flexible finger radially inward and the flexible finger preferably includes a tapered forward end defining a sharp edge to facilitate gripping of the cable. The gripping ferrule further preferably includes an annular radially inwardly directed flexible seal disposed on an inner rearward surface thereof for providing a substantially water-tight seal against the cable inserted into the connector.

The present invention further involves a method for terminating a coaxial cable in a connector. The method according to the present invention generally includes the step of inserting an end of a cable into a rearward cable receiving end of a connector body which has a gripping ferrule fixed therein for permitting forward insertion of the cable into the body but prevents rearward removal of the cable from the body. In this manner, the cable is secured to the connector without the need for any axial movement of a locking component of the connector.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
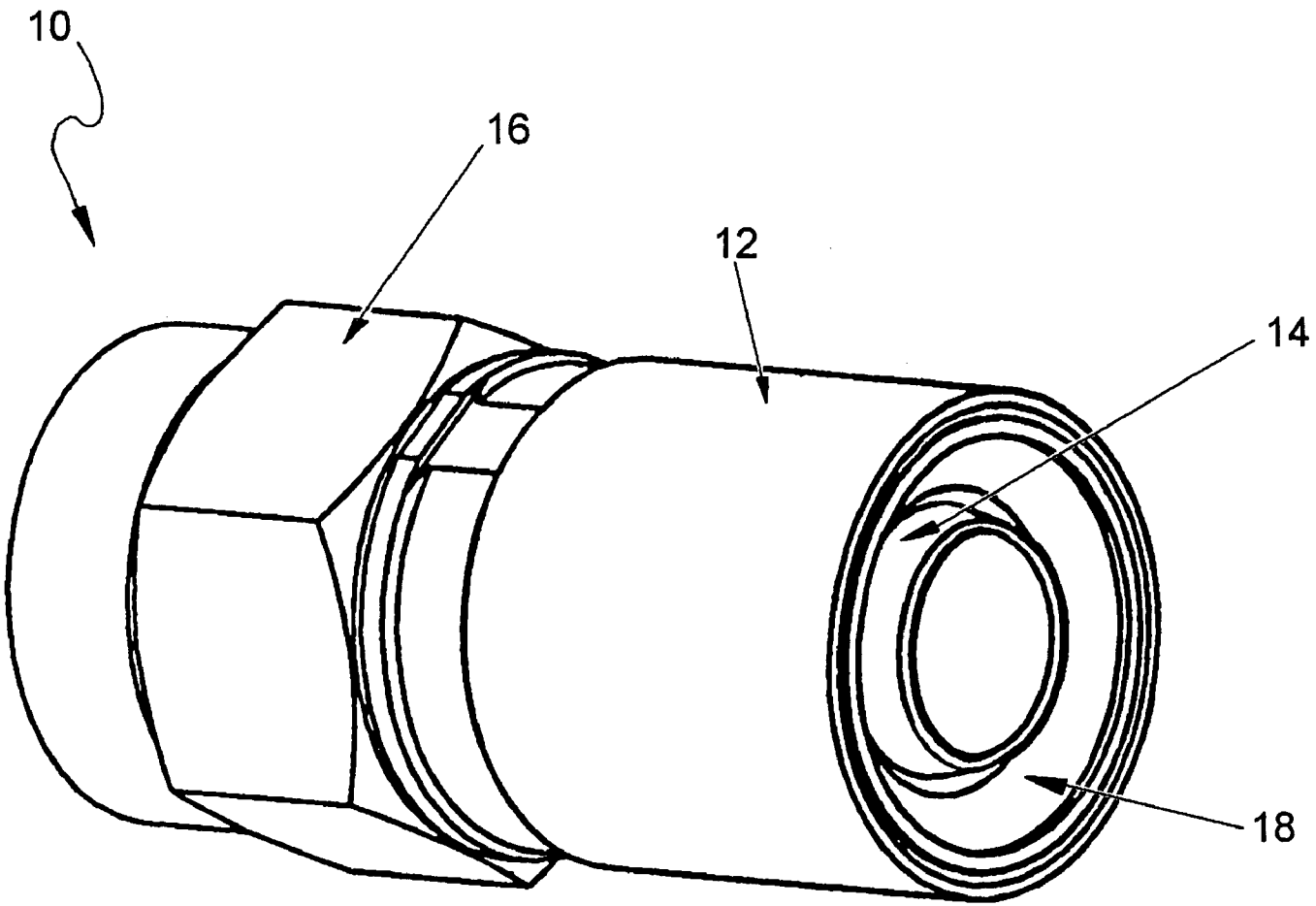
FIG. 1 is a perspective view of the coaxial cable connector of the present invention.
Figure 2:
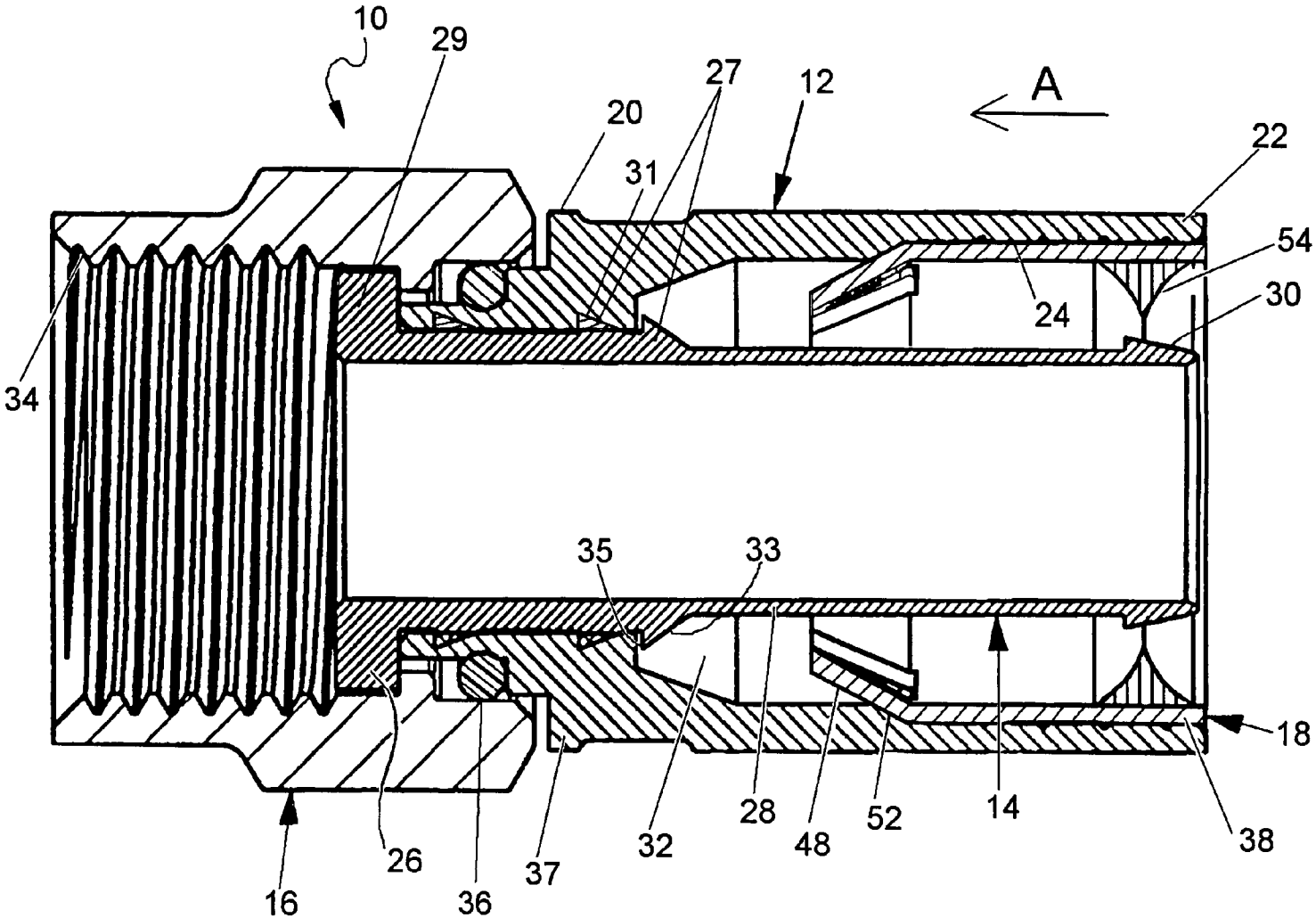
FIG. 2 is a cross-sectional view of the connector shown in FIG. 1.

Referring first to FIGS. 1 and 2, the coaxial cable connector 10 of the present invention is shown. The connector 10 generally includes four components: a connector body 12; an annular post 14; a rotatable nut 16; and a gripping ferrule 18. It is however conceivable that the connector body 12 and the post 14 can be integrated into one component and/or another fastening device other than the rotatable nut 16 can be utilized.

The connector body 12, also called a collar, is an elongate generally cylindrical member, which is preferably made from plastic to minimize cost. Alternatively, the body 12 may be made from metal or the like. The body 12 has one end 20 coupled to the post 14 and the nut 16 and an opposite cable receiving end 22 for insertably receiving a prepared end of a coaxial cable. Disposed within the cable receiving end 22 of the connector body 12 is the gripping ferrule 18. The cable receiving end 22 of the connector body 12 defines an inner engagement surface 24 for frictionally engaging the gripping ferrule 18, as will be described in further detail below.

The annular post 14 includes a flanged base portion 26 at its forward end, for securing the post in the nut 16, and one or more radially outwardly extending protrusions 27 disposed rearward of the flanged base portion, for securing the post within the collar 12. In particular, the nut 16 is formed with a post receiving groove or space 29 for receiving the flanged base portion 26 of the post 14. Upon assembly, the post 14 is first slipped into the nut 16 so that the flanged base portion 26 is received and retained within the post receiving space 29 of the nut. The rearward end of the post 14, with the nut 16 thus retained at its forward end, is then inserted into the forward end 20 of the collar 12 until one or more of the protrusions 27 is snap-fit into one or more internal grooves 31 formed in the collar. The protrusions 27 are preferably formed with a reardwardly facing chamfered wall 33, to facilitate rearward insertion of the post 14 into the collar 12, and a forwardly facing axially perpendicular wall 35 to prevent forward removal of the post from the collar. The collar 12 further includes a flange portion 37, which abuts against the nut 16 to prevent forward movement of the collar and post 14 with respect to the nut 16. In this manner, the collar 12, the post 14 and the nut 16 are retained together.

The annular post 14 further includes an annular tubular extension 28 extending within the body 12 and into the gripping ferrule 18. The distal end of the tubular extension 28 preferably includes a radially outwardly extending ramped flange portion or "barb" 30 for compressing the outer jacket of the coaxial cable against a seal portion of the gripping ferrule 18 to secure the cable within the connector, as will be described in further detail below. Alternatively, and/or depending on the method of forming the post 14, the barb 30 may be more rounded as opposed to a ramped flange. In any event, the tubular extension 28 of the post 14 and the body 12 define an annular chamber 32 for accommodating the jacket and shield of the inserted coaxial cable.

The nut 16 may be in any form, such as a hex nut, knurled nut, wing nut, or any other known attaching means, and is rotatably coupled to the post 14 for providing mechanical attachment of the connector 10 to an external device. The nut 16 includes an internally threaded end extent 34 permitting screw threaded attachment of the connector 10 to the external device. The cable receiving end 22 of the connector body 12 and the internally threaded end extension 34 define opposite ends of the connector 10. A resilient sealing O-ring 36 is preferably positioned between the body 12 and the nut 16 at the rotatable juncture thereof to provide a water resistant seal thereat.

Figure 4:
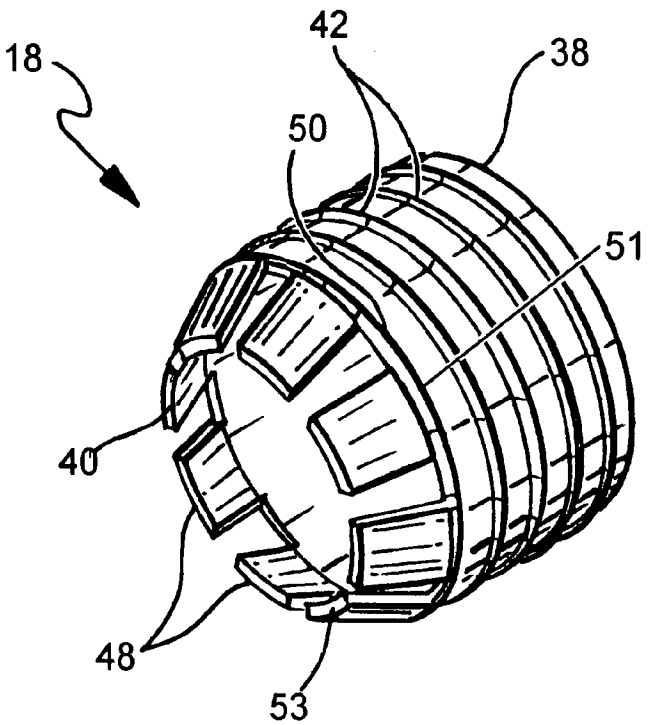
FIG. 4 is a perspective view of an alternative embodiment of the gripping ferrule sleeve component of the coaxial cable connector of the present invention.
Figure 3:
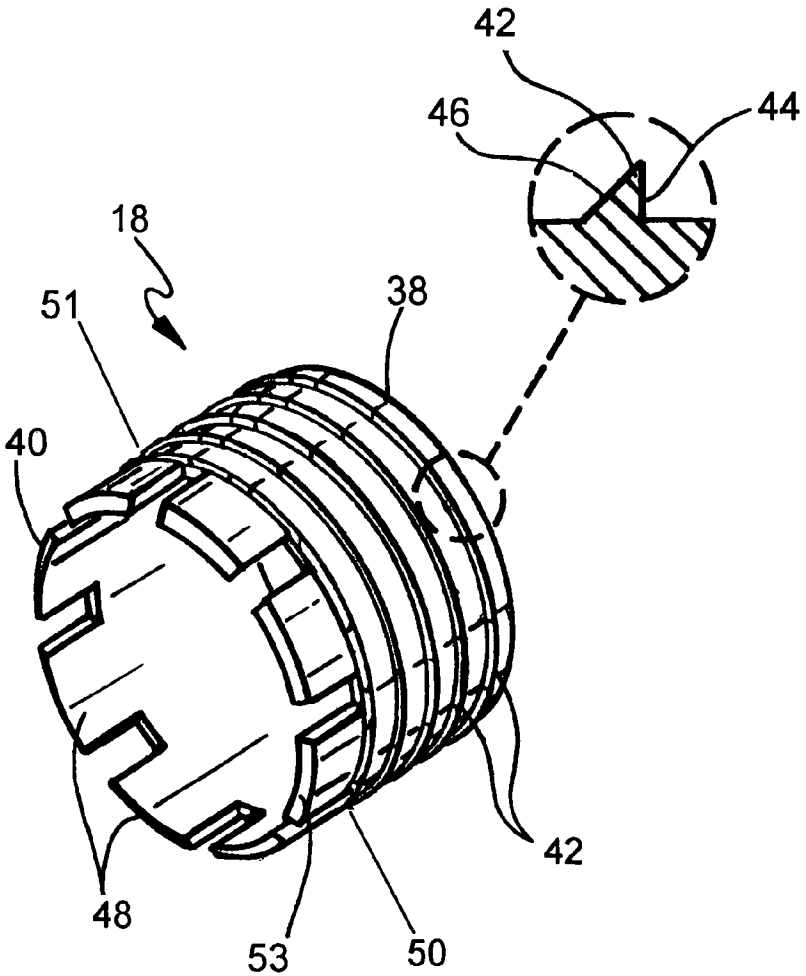
FIG. 3 is a perspective view of the gripping ferrule sleeve component of the coaxial cable connector of the present invention.

Referring additionally to FIGS. 3 and 4, the gripping ferrule 18 is a generally tubular member having a rearward cable receiving end 38 and an opposite forward cable gripping end 40. The gripping ferrule 18 is preferably made from a strong, durable plastic material to reduce costs, but may also be formed of a resilient metal. Adjacent its rearward end 38, the outer cylindrical surface of the gripping ferrule 18 preferably includes at least one radially raised ridge or projection 42 to enhance press-fit attachment of the gripping ferrule to the interior surface 24 of the cable insertion end 22 of the connector body 12. More preferably, there are a plurality of ridges 42 to increase the gripping and sealing force between the gripping ferrule 18 and the inner surface 24 of the connector body 12. Each ridge 42 may further be defined by a rearwardly facing perpendicular wall 44 and a forwardly facing chamfered wall 46. This structure facilitates forward insertion of the gripping ferrule 18 into the body 12 in the direction of arrow A and resists rearward removal of the ferrule from the body.

The forward end 40 of the gripping ferrule 18 is formed with a plurality of circumferentially arranged flexible fingers 48 extending in the forward direction. The fingers 48 may be formed simply by providing longitudinal slots or recesses at the forward end 40 of the ferrule 18. Moreover, the fingers 48 may extend coaxially straight from the end of the ferrule 18, as shown in FIG. 3, or the ferrule may be manufactured to provide a radially inward bend to the fingers 48, as shown in FIG. 4. When bent, the angle of the fingers 48 with respect to the centerline of the gripping ferrule 18 is preferably about 70-90 degrees.

In either event, a lateral groove 50 is also preferably provided between the fingers 48 and the body of the ferrule to increase the flexibility of the fingers. The lateral groove 50 also preferably defines a forward facing banking surface 51 at the juncture of the fingers 48 and the outer cylindrical surface of the body of the ferrule 18, which abuts against an internal banking structure 52 formed on the inner surface 24 of the connector body 12 to prevent further forward insertion of the ferrule within the rearward end 22 of the connector body.

The internal banking structure 52 is preferably in the form of an internal ramp portion of the connector body having a rearward facing ramped surface. As will be discussed in further detail below, the internal ramp portion 52 of the connector body 12 also forces the flexible fingers 48 to deflect radially inwardly during insertion of the gripping ferrule 18 into the body. These inwardly directed fingers 48 engage the outer jacket of the cable to enhance the gripping of the cable within the connector 10. In this regard, each of the fingers 48 may include a tapered end 53 so as to form a relatively sharp edge 53. The sharp edge 53 tends to bite into the cable to provide even greater gripping force and prevent the cable from being pulled out of the connector 10.

Figure 6:
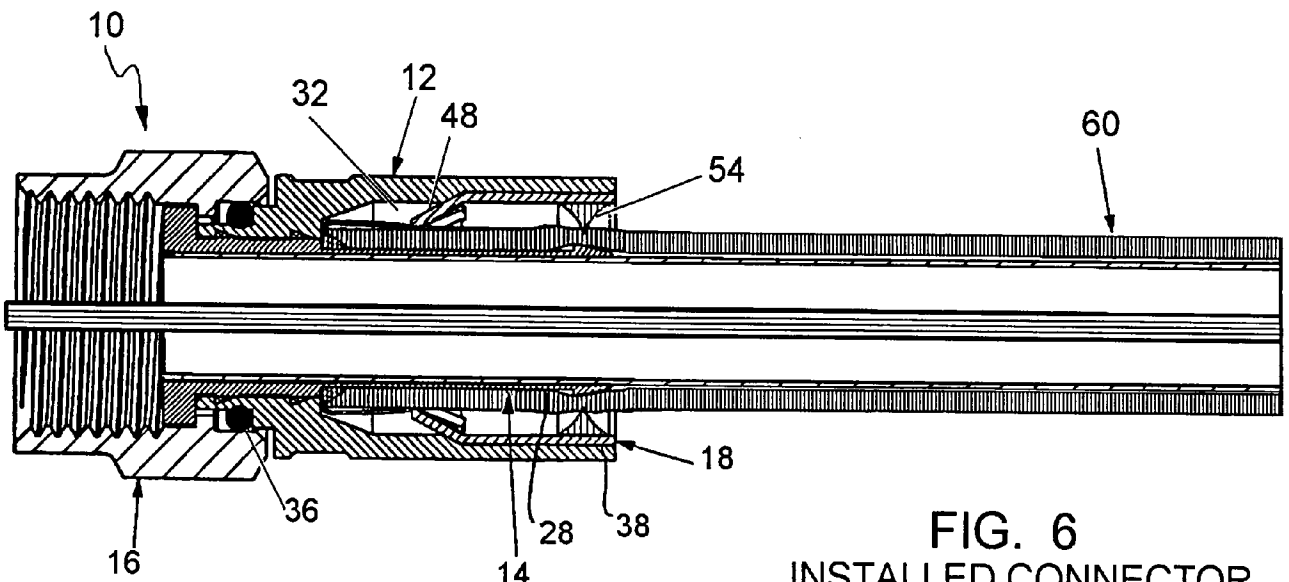
FIG. 6 is a cross-sectional view of the connector shown in FIG. 2 with a coaxial cable secured thereto.

As shown in FIGS. 1, 2 and 6, the inner surface of the rearward cable receiving end 38 of the gripping ferrule 18 is preferably provided with an annular, radially inwardly directed flexible seal 54. The flexible seal 54 is preferably formed of a resilient material, such as a soft-rubber elastomer. The flexible seal 54 is generally triangular in cross-section in the preferred configuration and is termed a "wiper seal" in that it "wipes" against the outer surface of a cable as the cable is inserted in the connector. Also, the seal 54 is preferably disposed adjacent the post barb 30 when the ferrule is fixed in the connector body 12, and is more preferably disposed juxtaposed to the barb in a radial direction. The seal 54 may be formed separately and subsequently fixed inside the rearward cable receiving end 38 of the gripping ferrule in a conventional manner, such as by an adhesive. The flexible seal 54 provides a water-tight seal against the outer jacket of the cable when the cable is installed in the connector.

The connector 10 of the present invention is constructed so as to be supplied in the assembled condition shown in FIGS. 1 and 2, wherein the gripping ferrule 18 is pre-installed inside the rearward cable receiving end 22 of the connector body 12. In such assembled condition, and as will be described in further detail hereinbelow, a coaxial cable 60 may be inserted through the rearward cable receiving end 38 of the gripping ferrule 18 to engage the post 14 of the connector 10.

Figure 5:
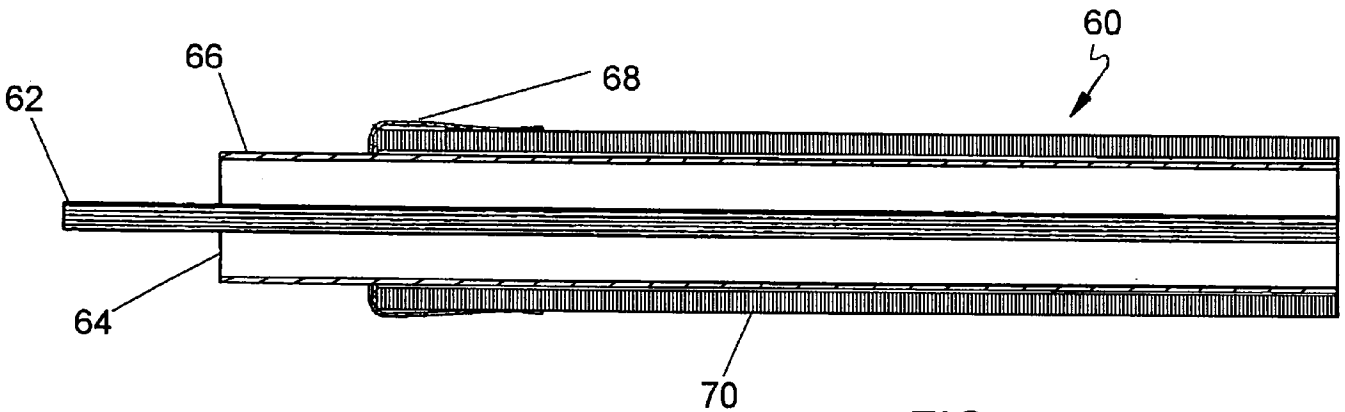
FIG. 5 is a cross-sectional view of a prepared end of a coaxial cable prior to installation.

Having described the components of the connector 10 in detail, the use of the connector in terminating a coaxial cable may now be described with respect to FIGS. 5 and 6. Coaxial cable 60 includes an inner conductor 62 formed of copper or similar conductive material. Extending around the inner conductor 62 is an insulator 64 formed of a dielectric material, such as a suitably insulative plastic. A metallic foil 66 is disposed over the insulator 64 and a metallic shield 68 is positioned in surrounding relationship around the foil covered insulator. Covering the metallic shield 68 is an outer insulative jacket 70.

Cable 60 is prepared in conventional fashion for termination by stripping back the jacket 70 exposing an extent of shield 68. A portion of the foil covered insulator 64 extends therefrom with an extent of conductor 62 extending from insulator 64. After an end extent of shield 68 is folded back about jacket 70, the cable 60 may be inserted into the connector 10 with the gripping ferrule 18 already coupled to the body 12, as shown in FIG. 6. In this technique, the prepared cable 60 is inserted through the rearward end 38 of the ferrule 18 and the extension 28 of the post 14 is inserted between the foil covered insulator 64 and the metallic shield 68 such that the shield and the jacket 70 reside within the annular region 32 defined between the post 14 and the connector body 18.

As the cable 60 is inserted, the jacket 70 and shield 68 of the cable 60 begin to become compressively clamped within the annular region 32 between the post 14 and the resilient fingers 48 of the gripping ferrule 18. The cable 60 is pushed fully into the collar 12 until the prepared end of the cable jacket 70 butts against the bottom of the internal collar cavity. As the cable 60 is forced under the fingers 48 of the gripping ferrule 18, it causes the fingers to deform outwardly and thereby exert pressure against the outside surfaces of the cable. If a force is applied on the cable 60 to pull it out of the connector 10, the sharp tips 53 of the fingers 48 will be pulled in the same direction resulting in increased pressure that prevents the easy removal of the cable.

Also during cable insertion, the flexible seal 54 deforms to allow cable entry but maintains engagement with the jacket 70 of the cable 60 to provide a redundant sealing point to prevent the ingress of water or other contaminants into the connector assembly 10. This feature eliminates the use of a separate O-ring and further reduces the manufacturing costs of the connector.

Thus, as a result of the present invention, a prepared cable can be installed on the connector without the need to purchase and use a separate tool. Instead, the present invention provides an attachment method that simply requires the prepared end of a coaxial connector to be pushed or slipped into the end of the connector. In the installed condition, the cable 60 is prevented from being easily pulled out of the connector by three points of pressure: a) the ridges 42 of the gripping ferrule 18 frictionally engaged against the inner surface of the body 12; b) the deflected fingers 48 of the ferrule exerting pressure on the cable caused by the inner slanted surface 52 of the body; and c) the cable jacket being compressed between the post barb 30 and the ferrule flexible seal 54.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward cable receiving end;

a stationary gripping ferrule fixed within said rearward cable receiving end of said connector body, said gripping ferrule including at least one flexible finger deflected in a radially inward direction and extending in a forward direction opposite said rearward cable receiving end of said connector body for permitting forward insertion of a cable into said connector body and for gripping the cable to prevent rearward removal of the cable from said connector body;

an annular post disposed within said connector body, said annular post including a tubular extension extending axially into said gripping ferrule; and a nut rotatably coupled to said post, wherein the cable is secured to the connector without any axial movement of said gripping ferrule.

2. A coaxial cable connector as defined in claim 1, wherein said connector body includes an internal ramp portion for supporting said deflected flexible finger in said radially inward direction.

3. A coaxial cable connector as defined in claim 1, wherein said connector body includes an internal ramp portion for deflecting said flexible finger radially inward.

4. A coaxial cable connector as defined in claim 1, wherein said gripping ferrule includes a forward facing banking surface and said connector body includes an internal banking structure formed on an inner surface thereof, said banking surface of said ferrule cooperating with said banking structure of said connector to prevent forward movement of said ferrule within said connector body.

5. A coaxial cable connector as defined in claim 1, wherein said flexible finger includes a tapered forward end defining a sharp edge to facilitate gripping of the cable.

6. A coaxial cable connector as defined in claim 1, wherein said flexible fingers are deflected with respect to a center axis of said gripping ferrule at an angle in the range of between 70 and 90 degrees.

7. A coaxial cable connector as defined in claim 1, wherein said flexible finger of said gripping ferrule is adapted to resiliently engage an outer jacket of the cable during forward insertion of the cable into said connector body.

8. A coaxial cable connector as defined in claim 1, wherein gripping ferrule comprises a plurality of flexible fingers, said fingers adapted to radially outwardly deform during forward insertion of the cable into said connector body.

9. A coaxial cable connector as defined in claim 1, wherein said flexible finger and said post tubular extension define an annular gap therebetween, said gap being sufficiently large to permit forward passage of at least an outer jacket of the cable to pass between said finger and said post tubular extension during forward insertion of the cable into said connector body.

10. A coaxial cable connector as defined in claim 1, wherein said gripping ferrule includes at least one raised ridge formed on an outer circumferential surface thereof for enhancing press-fit attachment of said ferrule within said connector body.

11. A coaxial cable connector as defined in claim 10, wherein said ridge includes a rearwardly facing radially perpendicular wall, for preventing rearward removal of the ferrule from within said connector body, and a forwardly facing chamfered wall, for facilitating forward insertion of the ferrule into the connector body on assembly.

12. A coaxial cable connector as defined in claim 1, wherein said gripping ferrule includes an annular radially inwardly directed flexible seal disposed on an inner rearward surface thereof for providing a substantially water-tight seal against the cable inserted into the connector.

13. A coaxial cable connector as defined in claim 12, wherein said flexible seal is a wiper seal having a triangular cross-section.

14. A coaxial cable connector comprising:

a connector body having a rearward cable receiving end;

a stationary gripping ferrule fixed within said rearward cable receiving end of said connector body, said gripping ferrule including at least one flexible finger deflected in a radially inward direction and extending in a forward direction opposite said rearward cable receiving end of said connector body for permitting forward insertion of a cable into said connector body and for gripping the cable to prevent rearward removal of the cable from said connector body, wherein said gripping ferrule further includes an annular radially inwardly directed flexible seal disposed on an inner rearward surface thereof for providing a substantially water-tight seal against the cable inserted into the connector; and an annular post disposed within said connector body, said annular post including a tubular extension extending axially into said gripping ferrule and terminating at a radially outwardly extending barb, said barb being disposed radially juxtaposed to said gripping ferrule flexible seal.

15. A method for terminating a coaxial cable in a connector comprising the step of inserting an end of a coaxial cable into a rearward cable receiving end of a connector body, the connector body having a stationary gripping ferrule fixed within said rearward cable receiving end of said connector body which permits forward insertion of the cable into the body but prevents rearward removal of the cable from the body, wherein the cable is secured to the connector without any axial movement of said gripping ferrules wherein said gripping ferrule prevents rearward removal of the cable with at least one flexible finger deflected in a radially inward direction and extending in a forward direction opposite said rearward cable receiving end of said connector, said finger gripping the cable to prevent rearward removal thereof, wherein said connector further comprises an annular post disposed within said connector body and including a tubular extension extending axially into said gripping ferrule, and wherein said cable inserting step comprises the step of passing at least an outer jacket of the cable through an annular gap defined between said flexible finger and said post tubular extension during forward insertion of the cable into said connector body.

16. A method as defined in claim 15, further comprising the step of sealing an outer surface of the cable with an annular radially inwardly directed flexible seal disposed on an inner rearward surface of said gripping ferrule.

17. A method as defined in claim 15, wherein said cable inserting step comprises the step of resiliently engaging an outer jacket of the cable with said flexible finger of said gripping ferrule during forward insertion of the cable into said connector body.

18. A method as defined in claim 15, wherein said cable inserting step comprises the step of deforming a plurality of flexible fingers of said gripping ferrule radially outwardly during forward insertion of the cable into said connector body.

* * * * *